US006883784B1

(12) United States Patent
Sloneker et al.

(10) Patent No.: US 6,883,784 B1
(45) Date of Patent: Apr. 26, 2005

(54) BOAT LIFT USING ONE-WAY CLUTCH

(76) Inventors: William L. Sloneker, 6224 Lakeland Ave., Brooklyn Park, MN (US) 55428; Mark D. Solvie, 523 N. Oak St., Holdenville, OK (US) 74848

( * ) Notice: Subject to any disclaimer, the term of this patent is extended or adjusted under 35 U.S.C. 154(b) by 0 days.

(21) Appl. No.: 10/686,131

(22) Filed: Oct. 14, 2003

Related U.S. Application Data

(60) Provisional application No. 60/417,921, filed on Oct. 11, 2002.

(51) Int. Cl.[7] ..... B66D 1/14
(52) U.S. Cl. ..... 254/366; 254/368; 254/375
(58) Field of Search ..... 254/342, 346, 254/347, 350, 356, 365, 366, 368, 375; 242/295, 242/298

(56) References Cited

U.S. PATENT DOCUMENTS

| | | | | |
|---|---|---|---|---|
| 90,992 A | | 6/1869 | Cardot | |
| 1,952,728 A | * | 3/1934 | Rathbun | 254/269 |
| 2,219,401 A | | 10/1940 | Sampsell | |
| 3,642,253 A | * | 2/1972 | Baldwin et al. | 254/375 |
| 3,985,341 A | | 10/1976 | Akre | |
| 4,084,793 A | | 4/1978 | Gardiner | |
| 4,257,577 A | | 3/1981 | Eriksson et al. | |
| 4,291,864 A | * | 9/1981 | Reynolds | 254/375 |
| 4,470,745 A | | 9/1984 | Shotwell | |
| 4,565,352 A | | 1/1986 | Hasselmann et al. | |
| 5,188,341 A | | 2/1993 | Greaves | |
| 5,271,607 A | * | 12/1993 | Kubota et al. | 254/342 |
| 5,284,325 A | * | 2/1994 | Sasaki et al. | 254/274 |
| 5,374,035 A | | 12/1994 | Santos | |
| 5,535,988 A | * | 7/1996 | Nishimura | 254/352 |
| 5,626,303 A | * | 5/1997 | Bringsen | 242/265 |
| 5,641,151 A | * | 6/1997 | Kataoka | 254/352 |
| 5,897,105 A | | 4/1999 | Huggett et al. | |
| 6,021,692 A | | 2/2000 | Norfolk et al. | |
| 6,047,955 A | | 4/2000 | Cavanagh | |
| 6,352,243 B1 | * | 3/2002 | Samejima | 254/352 |
| 6,554,255 B1 | * | 4/2003 | Fujikawa | 254/358 |
| 6,578,824 B1 | * | 6/2003 | Samejima | 254/366 |

* cited by examiner

*Primary Examiner*—Emmanuel Marcelo
(74) *Attorney, Agent, or Firm*—Albert W. Watkins

(57) ABSTRACT

A boat lift uses a one-way roller bearing in association with a friction disc clutch. A hand-wheel operator provides power input, though a motor may be substituted therefore. A gearing arrangement, a one-way roller bearing and friction clutch, a cable and cable reel for selectively providing tensile force, and a boat support such as a custom hull support or suitable adjustable or universal boat support round out the lift components. Novel couplings permit the handwheel to be rotated and translated axially.

19 Claims, 3 Drawing Sheets

BOAT LIFT USING ONE-WAY CLUTCH

CROSS REFERENCE TO RELATED APPLICATIONS

This application claims priority to U.S. provisional application 60/417,921 filed Oct. 11, 2002 and co-pending herewith, the contents which are incorporated herein by reference in entirety.

BACKGROUND OF THE INVENTION

1. Field of the Invention

This invention pertains generally to implements or apparatus for applying pushing or pulling force, and more particularly to an improved boat lift used to raise boats from a body of water and subsequently lower them back into the water.

2. Description of the Related Art

Owners of waterfront properties, resort owners, and other persons who regularly access or provide access to bodies of water must store marine craft. Most preferably, this storage is as convenient as possible, and as close and readily accessible to the shoreline as possible. Frequently, docks, piers or the like are provided that extend into the water body from the actual shoreline, above water level to permit dry passage, and that extend a distance sufficient to reach a water depth adequate for safe passage of marine craft. When the water craft are repetitively used, they may be left adjacent the dock or secured thereto, and are consequently available for immediate use. Unfortunately, the vagaries of weather frequently require the water craft to be removed, such as when a severe storm approaches, or when the body of water might freeze. Additionally, minor servicing, painting, hull inspections and the like will also necessitate the removal of the water craft from the water.

Some persons prefer to launch the water craft from trailer and then return the water craft to the trailer. By removing the water craft from the water, no further efforts need to be made to prepare for storms and the like. Unfortunately, to reasonably unload and reload the water craft from trailer generally requires a significant amount of time, available landing access, storage space for vehicle and trailer, and also generally requires more than one person. Additionally, the use of a trailer all too frequently results in the water craft being accidentally damaged just in the loading and unloading operations. Consequently, the water craft is not readily available for use, and may require multiple persons to ready the water craft for use.

To provide more convenient storage and use of the water craft, and reduce the risks of damage or the need to remove the water craft in the event of adverse weather or the like, boat lifts have been designed that may be placed within the water adjacent the dock. Alternatively, these lifts may include attachment directly to the dock. To enable the water craft, which may typically be a motor boat, personal water craft, or the like, though not strictly limited thereto, to be raised or lowered, the boat lift will typically comprise an operator for power input, whether manual or motorized, a gearing arrangement, some type of safety system, whether a ratcheting system or some other equivalent means, and a boat support such as a custom hull support or suitable adjustable or universal boat support. In the case of manual systems, a large wheel is frequently provided, typically several feet in diameter, which may be easily handled and operated by most persons.

The safety system is necessitated by the weight of the water craft, and the possibility for damage to the water craft or injury to persons in the event the water craft is undesirably released in an uncontrolled manner. Unfortunately, ratchet systems tend to be relatively large, somewhat cumbersome, extremely noisy, and exposed gears may in and of themselves present a safety hazard.

As an alternative, motorized systems have been proposed that combine motor with worm gear transmission system. The resistance of the motor, which is further magnified through the worm gear, is adequate to prevent the lift from running away and the water craft from undesirably falling. Exemplary of such system is U.S. Pat. No. 6,021,692 to Norfolk et al, the teachings which are incorporated herein by reference. Nevertheless, and acknowledged in the Norfolk et al patent, the use of electric motors is disadvantageous in many applications. The environment within which these motors must be operated is frequently harsh, and often leads to early failure. As such, the reliability of a motorized system suffers. Furthermore, not all locations will have ready access to power, particularly near the water. Finally, the system as a whole cannot be designed to operate as reliably as a manual system, and maintenance takes time away from the primary activity, boating.

SUMMARY OF THE INVENTION

In a first manifestation, the invention is a manual boat winch hoist control mechanism. A handwheel has a central hub and a first threaded bore. A housing provides environmental protection. A shaft having an outside threaded surface is coupled at a first end to the first threaded bore. The shaft includes a friction engaging member, and passes from housing interior to exterior. A friction thrust member is located axially between handwheel hub and shaft friction engaging member, and provides a friction surface to frictionally engage the shaft friction engaging member, to thereby provide controllable slipping and locking up by change of pressure between shaft friction engaging member and friction thrust member. A one-way roller clutch is fixed against motion relative to the housing and is coupled to the friction thrust member. The one-way roller clutch provides radial support and limits rotation of the friction thrust member to a single rotary direction about a rotary axis.

In a second manifestation, the invention is a boat winch hoist control mechanism providing roller bearing rotation to raise a boat, and friction clutch slip to lower the boat. A motive power source induces rotation in a first direction about an axis and in a second direction of rotation opposed thereto. A friction thrust member is engageable with a friction drive member within a rotary shaft, to prevent relative movement therebetween. A one-way clutch is coupled to the friction thrust member which permits free rotation in a first shaft rotation direction and which prevents rotation in an opposed direction. A friction clutch actuator engages the friction thrust member to the friction drive member responsive to relative rotary displacement between the motive power source and rotary shaft in a first direction about an axis and disengages the friction thrust member from friction drive member responsive to relative rotary displacement between motive power source and rotary shaft in a second direction of rotation about an axis opposed to the first direction.

In a third manifestation, the invention is a method of raising and lowering a water craft using a one-way clutch to prevent unintentional lowering of a water craft and a friction clutch to enable intentional lowering of said water craft.

According to the method, a rotary force is applied in a first direction to a hub, thereby rotating the hub. A friction clutch is engaged responsive to hub rotation in the first direction. A cable is wound about a cable reel responsive to rotating and engaging to raise a water craft to a first elevation, and the applying of rotary force to hub is discontinued. A one-way clutch is locked responsive to the discontinuing, to maintain the raised water craft at the first elevation. A rotary force is established in a second direction opposed to the first rotary force direction to the hub, thereby rotating the hub in the second direction. The friction clutch is disengaged responsive to hub rotation in the second direction. Cable is unwound from cable reel responsive to the locking and disengaging.

OBJECTS OF THE INVENTION

Exemplary embodiments of the present invention solve inadequacies of the prior art by providing a one-way roller bearing in association with a friction disc clutch, whereby the friction disc clutch selectively couples input motive power to gearing and cable reel.

A first object of the invention is to provide a quiet and reliable boat lift operator. A second object of the invention is to enable manual operation, while not preventing appropriate couplings to an electric or other type of motorized drive. Another object of the present invention is to enable safe operation without the commonly associated noise of a ratchet system. A further object of the invention is to provide a small and compact drive system which is capable of raising and lowering substantial loads in a safe and reliable manner.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
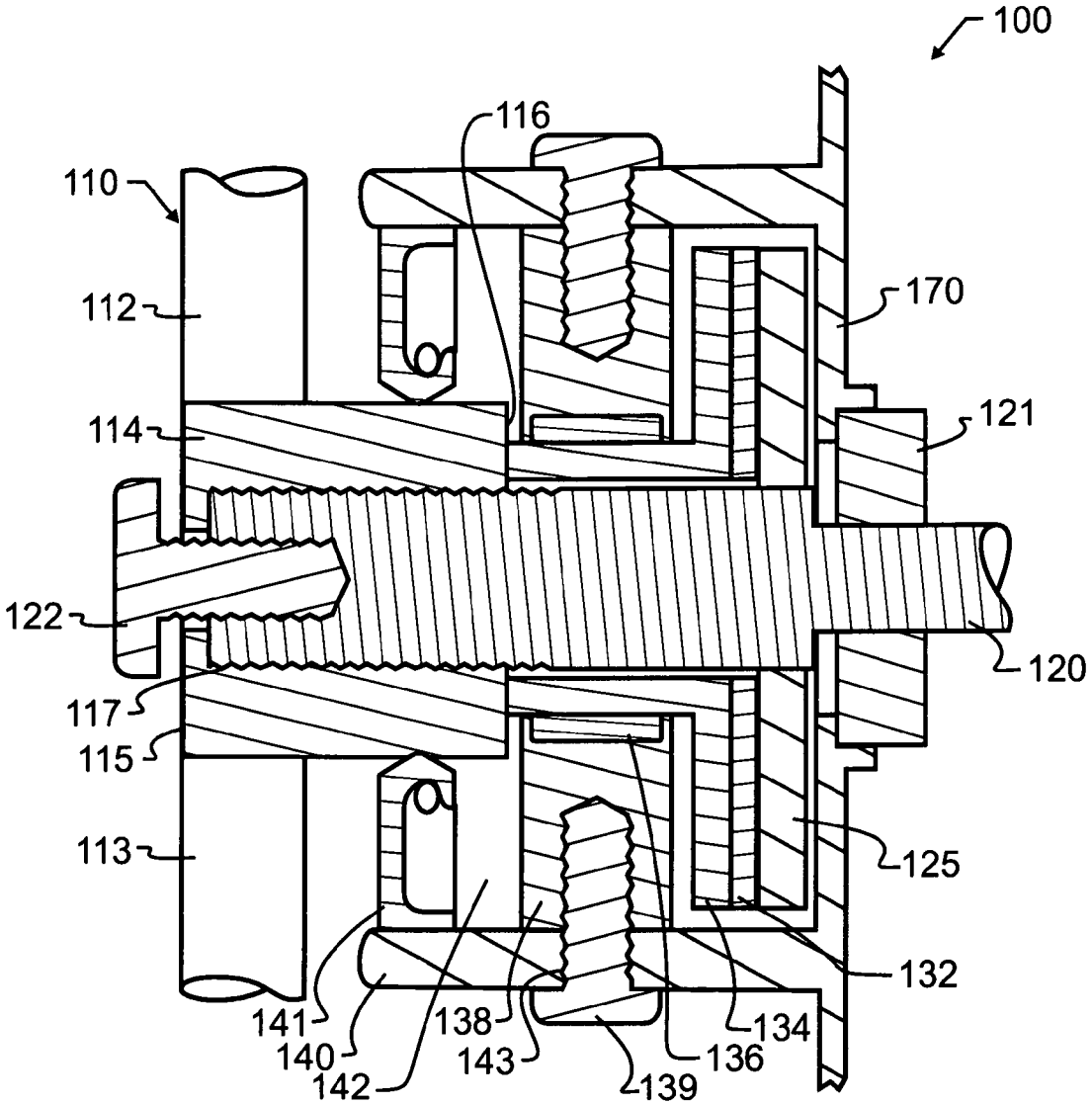
FIG. 1 illustrates a most preferred one-way roller bearing and friction plate clutch designed in accord with the teachings of the present invention from a cross-section view.

Manifested in the preferred embodiment, the present invention provides a hand-wheel operator for power input, though a motor may be substituted therefore, a gearing arrangement, a one-way roller bearing and friction clutch, a cable and cable reel for selectively providing tensile force, and a boat support such as a custom hull support or suitable adjustable or universal boat support. As illustrated by cross-sectional view in FIG. 1, operative control of the preferred embodiment boat lift 100 is provided through hand wheel 110, which has radially extending spokes 112, 113 that will typically join at a first outer end to an outer ring or circle (not shown) which may readily be grasped by a person, as is known in the art of manually operated boat lifts. Radially extending spokes 112, 113 join at an inner end to hub 114 of hand wheel 110, which includes an outside operative surface 115 and an inside operative surface 116.

Hand wheel 110 is threaded through threads 117 onto shaft 120 in such manner as to permit relative movement therebetween, by relative rotation about threads 117. For reasons that will be explained herein below, this permits hand wheel 110 to be threaded onto shaft 120 by a certain number of turns that will be varied during operation. Shaft 120 is carried upon bearing 121 which in the referred embodiment may be pressed into housing wall 170. At the end of shaft 120 adjacent hand wheel 110 is a fix bolt 122, which in the preferred embodiment is several turns removed from contacting hand wheel hub 114 when hand wheel 110 is being operatively turned to raise a water craft or other load.

A generally cylindrical snout 140 protrudes from housing 170 and encloses a chamber 142 by the combination of housing 170, shaft 120 and bearing 121 at a first end, and seal 141, hub 114 and shaft 120 at the end distal to bearing 121. Within chamber 142 is clutch carrier 138, which is restrained against rotation relative to snout 140 by a pair of bolts 139 that pass through snout 140 and holes 143. Clutch carrier 138 carries therein a one-way roller bearing 136, also known as a one-way clutch or a frictionless one-way clutch. One-way roller bearing 136 is operative with thrust plate assembly 134 to permit rotation of thrust plate assembly 134 in a first direction of rotation relative to snout 140, but not in a direction opposed thereto.

During operation of boat lift 100, hand wheel 110 will be rotated in a first direction to retract a cable and thereby, through appropriate mechanical coupling between cable and boat well known in the art, raise a boat from the water. This direction of rotation is such that hub 114, through threads 117, will turn onto shaft 120 and inside operative surface 116 will engage with thrust plate assembly 134. Further rotation will cause thrust plate assembly 134 to be pressed towards friction disk 132, and in turn will squeeze friction disk 132 between thrust plate assembly 134 and friction drive plate 125. When sufficient compressive force is applied to friction disk 132, hand wheel 110 will no longer spin relative to shaft 120, and will instead drive shaft 120 into synchronous rotation. This synchronous rotation will, as will be further explained herein below, in turn be used to retract a cable. While in the preferred embodiment, a separate friction disk 132 of material different from thrust plate assembly 134 and friction drive plate 125 is used, this disk may not be necessary. The use and selection will depend upon the particular application or anticipated load, the extent of gear reduction used, and the materials used in thrust plate assembly 134 and friction drive plate 125. Many alternatives may exist, including the selection of suitable materials for thrust plate assembly 134 and friction drive plate 125 that have the needed properties, the formation of surfaces, coatings or materials integral to either or both thrust plate assembly 134 and friction drive plate 125, or other known techniques.

In the event hand wheel is then turned in an opposed direction of rotation from that necessary to retract a cable, one-way roller bearing 136 will prevent thrust plate assembly 134 from following. Since thrust plate assembly 134 is frictionally locked through friction disk 132 and friction drive plate 125 to shaft 120, hand wheel 110 will begin to unthread from shaft 120. When this unthreading has completed a requisite number of turns, the frictional engagement between thrust plate assembly 134, through friction disk 132 and friction drive plate 125 will be overcome by the weight of the load upon the cable, which will in turn permit shaft 120 and friction drive plate 125 to turn relative to thrust plate assembly 134. Presuming a human operator is still holding hand wheel 110, and for a moment presuming that the rotation of hand wheel 110 has ceased, this rotation of shaft 120 will lead to a renewed threading of hand wheel 110 onto shaft 120, which will in turn increase the frictional forces between thrust plate assembly 134, friction disk 132 and friction drive plate 125. In other words, shaft 120 cannot run away from hand wheel 110, since such rotation will lead to increased drag and ultimate locking through one-way roller bearing 136. Consequently, as long as hand wheel 110 is being turned to lower the load, shaft 120 will follow, until the load is not longer pulling upon shaft 120. While this event will be apparent and sensed by the operator, there is the possibility that the operator will continue to turn hand wheel 110. In order to prevent hand wheel 110 from fully releasing from shaft 120, fix bolt 122 has been provided. Fix bolt 122 will simply retain hand wheel 110 to shaft 120, and prevent complete though unintended removal therefrom.

Figure 2:
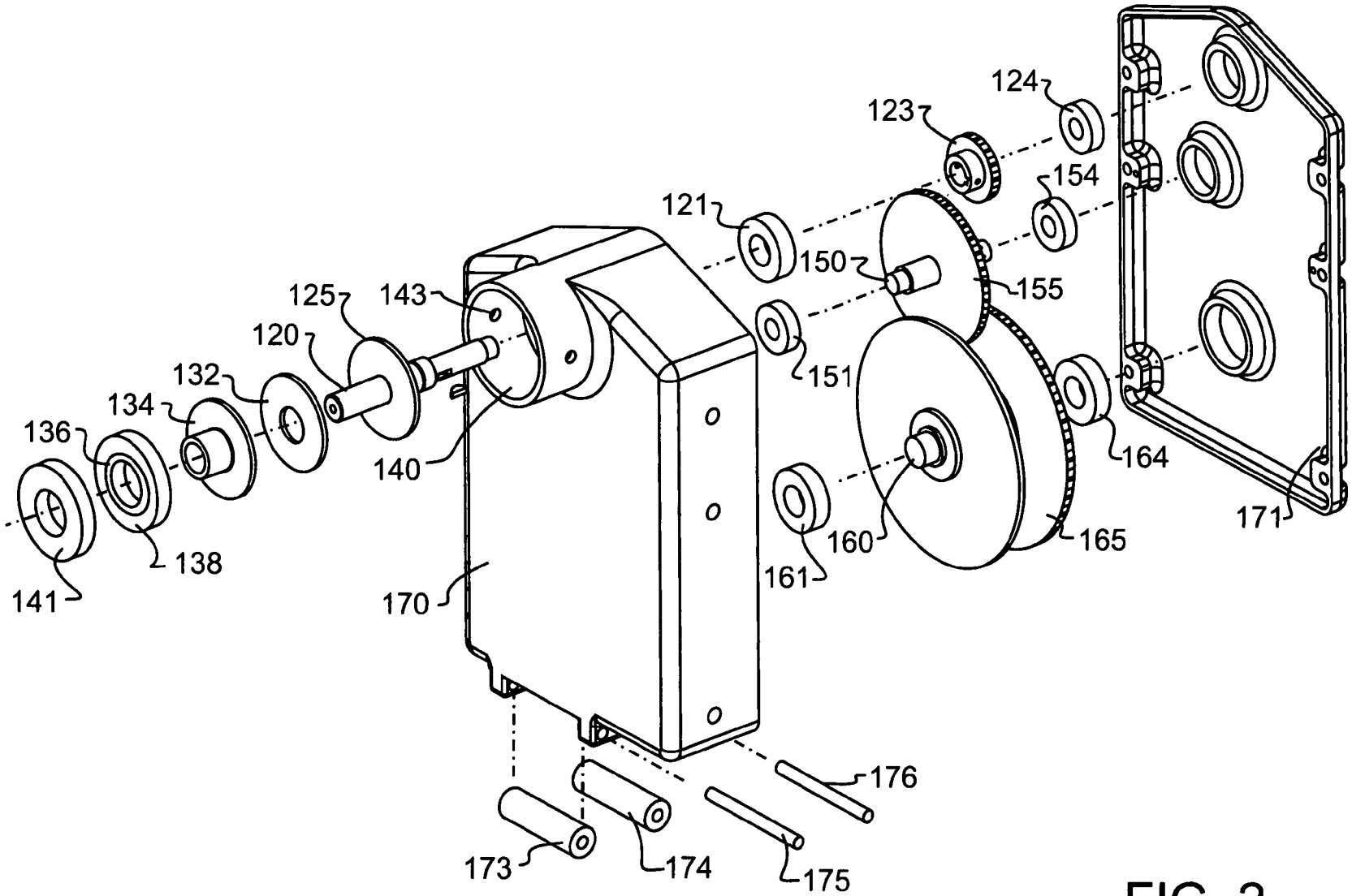
FIG. 2 illustrates a most preferred housing integrating the most preferred one-way roller bearing and friction plate clutch of FIG. 1 into a gearing system and cable reel which is relatively sealed, designed in accord with the teachings of the present invention, from an exploded projected assembly view.

FIG. 2 illustrates the most preferred one-way roller bearing and friction plate clutch of FIG. 1 further coupled into a gearing system and cable reel which is relatively sealed, from an exploded projected assembly view. The assembly sequence begins with the insertion of shaft 120 carrying friction drive plate 125 into snout 140, and the placement of friction disk 132, thrust plate assembly 134, and clutch carrier 138 carrying one-way roller bearing 136 about shaft 120 within snout 140. Bolts 139 will be placed through holes 143 and engaged with clutch carrier 138, and seal 141 will be installed.

Figure 3:
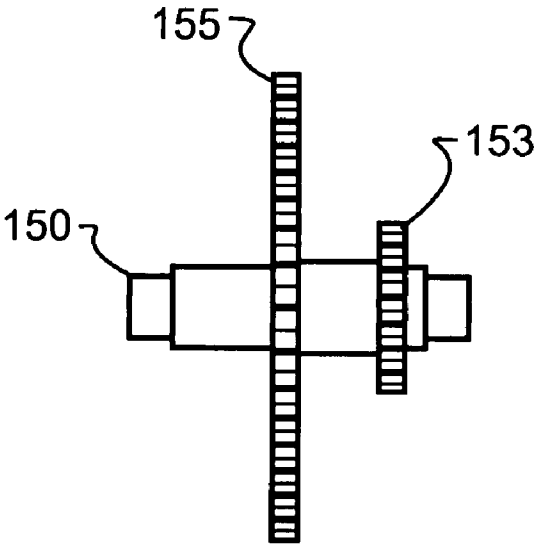
FIG. 3 illustrates a preferred embodiment intermediate shaft designed in accord with the teachings of the present invention for use in the gearing system of FIG. 2 from a front plan view.

Housing 170 may then be rotated, and installation of many of the remaining components will occur from within the space defined by the internal cavity of housing 170. Bearing 121 will be slipped about shaft 120, and then input sprocket 123 will be placed about the shaft, most preferably retained against rotation by a combination of woodruff key and set screws. FIG. 2 adequately illustrates the installation of the remaining components, though the operational relationships merit additional description. Input sprocket 123 is, in the assembled position, immediately adjacent drive sprocket 155, and will have a chain coupling therebetween. While gears or other methods of coupling may be used as will be understood, the chain and sprocket coupling is preferred herein. Similarly, sprocket 153, which is best visible in FIG. 3, couples to sprocket 165 through an intermediate chain. Consequently, power input from large diameter hand wheel 110 is transmitted from relatively small sprocket 123 to larger drive sprocket 155, and again from smaller sprocket 153 to much larger sprocket 165. This achieves significant gear reduction, though as aforementioned, other suitable techniques including cycloidal or planetary gearing systems are contemplated herein.

Figure 4:
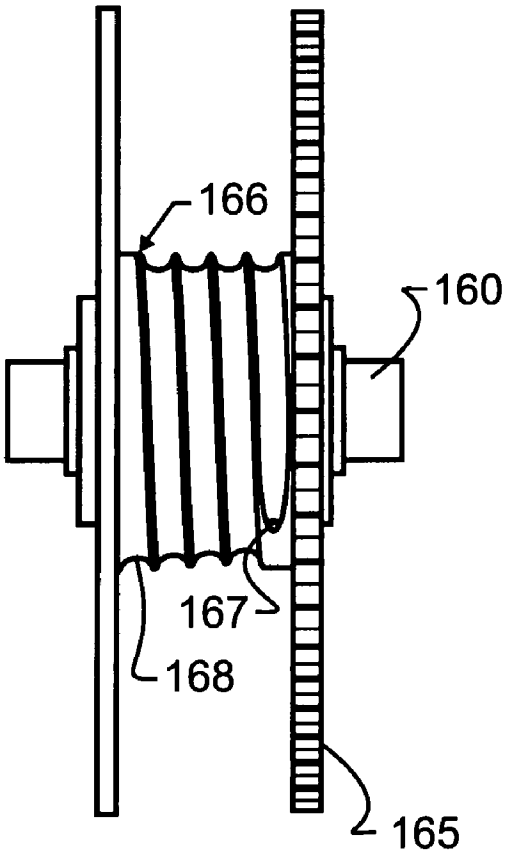
FIG. 4 illustrates a preferred reel shaft designed in accord with the teachings of the present invention for use in the gearing system of FIG. 2 from a front plan view.

FIG. 4 illustrates from front view reel shaft assembly 160. As can be seen therein, reel shaft 166 includes a helically cut cable guide 168, which will most preferably assist in the initial wrapping of cable. Once the first wrapping is completed, the undulations between adjacent cable winds will continue the proper wrapping therein. A cable termination 167 is provided, which wil serve to securely anchor the cable to reel shaft 166. The cable will be wound about reel shaft 166 between sprocket 165 and side plate 162.

Returning now to FIG. 2, the cable will pass from reel shaft assembly 160 through housing 170 and between rollers 173, 174, which are supported upon and rotate about pins 175, 176, respectively. Most desirably, rollers 173, 174 will snugly engage the cable therein, providing adequate guide and avoiding undesired frictional wear between the cable and any of the remaining components.

As may now be understood, the most preferred one-way roller bearing and friction plate clutch cooperate with the additional power transmission components to provide a boat lift which is compact, silent and smooth in operation, and which is self limiting when a water craft is being lowered. The components included herein are relatively simple in nature, and sufficiently durable to withstand the vagaries of the marine environment to which they will be exposed. Outer housing 170 will, of course, provide some protection. Nevertheless, and as is known, corrosive and harmful elements will over time find a way to intrude. Consequently, this combination of mechanical components offers much in the way of reliability. Nevertheless, as may be apparent, the means used to provide power into shaft 120 is not limited to hand wheel 110, and hand wheel 110 may be replaced by electric or other motive power sources. This replacement will, however, most preferably still provide a hub functionally equivalent to hub 114. Said another way, the radial spokes 112 and 113 may be replaced, for example, by chain and sprocket or belt and pulley configurations that include engines or motors to provide the motive force.

While the foregoing details what is felt to be the preferred embodiment of the invention, no material limitations to the scope of the claimed invention are intended. The variants that would be possible from a reading of the present disclosure are too many in number for individual listings herein, though they are understood to be included in the present invention. Further, features and design alternatives that would be obvious to one of ordinary skill in the art are considered to be incorporated herein. As an example only, and not limiting thereto, while the preferred embodiment illustrated herein uses the rotary movement of hub 114 to induce axial motion through threads upon a shaft many other techniques will be understood to be suitable for the conversion of intent to raise and lower into the mechanical operation after a reading of the present disclosure. Consequently, the scope of the invention is not limited to those features explicitly disclosed, but is instead set forth and particularly described in the claims herein below.

We claim:

1. A manual boat winch hoist control mechanism, comprising:

a handwheel with a central hub and a first threaded bore in said central hub;

a housing having an interior providing environmental protection;

a shaft having an outside threaded surface coupled at a first end to said first threaded bore, and having a friction engaging member, and passing from said housing interior to an exterior thereof;

a friction thrust member located axially between said handwheel hub and said shaft friction engaging member providing a friction surface to frictionally engage said shaft friction engaging member, to thereby provide controllable slipping and locking up by change of pressure between said shaft friction engaging member and said friction thrust member; and a one-way roller clutch, fixed against motion relative to said housing and coupled to said friction thrust member, that provides radial support and limits rotation of said friction thrust member to a single rotary direction about a rotary axis.

2. The manual boat winch hoist control mechanism of claim 1, further comprising a seal extending from said housing toward said shaft at least limiting the influx of environmental contaminants into said housing interior while permitting rotation of said handwheel and said shaft relative to said housing.

3. The manual boat winch hoist control mechanism of claim 1 further comprising:

a second bore in said handwheel central hub; and a fixation fastener passing through said handwheel second bore and coupled to said shaft to limit travel of said handwheel relative to said shaft as said handwheel is rotated in a de-clutching direction.

4. The manual boat winch hoist control mechanism of claim 3 where said fixation fastener is threaded to mate with threads in said shaft first end.

5. The manual boat winch hoist control mechanism of claim 1 further comprising a friction disc between said friction engaging member and said friction thrust member.

6. The manual boat winch hoist control mechanism of claim 5 wherein said friction disc is generally shaped as a disc and mates with said shaft and said friction thrust member.

7. The manual boat winch hoist control mechanism of claim 1 where said one-way roller clutch is fixed against relative motion to said housing by threaded fasteners passing through said housing and into threaded recesses in a clutch carrier, said clutch carrier further engaging said one-way roller clutch.

8. A boat winch hoist control mechanism providing roller bearing rotation to raise said boat, and friction clutch slip to lower said boat, comprising:

a motive power source for inducing rotation in a first direction about an axis and in a second direction of rotation opposed thereto;

a friction thrust member;

a rotary shaft having a friction drive member that is engageable with said friction thrust member to prevent relative movement therebetween;

a one-way clutch coupled to said friction thrust member which permits said friction thrust member to rotate freely in a first shaft rotation direction and which prevents rotation of said friction thrust member in a direction opposed to said first shaft rotation direction; and a friction clutch actuator which engages said friction thrust member to said friction drive member responsive to relative rotary displacement between said motive power source and said rotary shaft in a first direction about an axis and which disengages said friction thrust member from said friction drive member responsive to relative rotary displacement between said motive power source and said rotary shaft in a second direction of rotation about said axis opposed to said first direction.

9. The boat winch hoist control mechanism of claim 8 wherein said motive power source further comprises a handwheel suitable for rotation by a person.

10. The boat winch hoist control mechanism of claim 9 wherein said friction clutch actuator is engaged to couple rotation from said handwheel to said shaft when said handwheel is rotated in a first handwheel direction of rotation and which is disengaged to permit relative rotation between said handwheel and said shaft when said handwheel is rotated in a second handwheel rotation direction, and, when said handwheel is released after rotation in said first direction, which prevents rotation of said shaft and thereby maintains said boat in a raised position.

11. The boat winch hoist control mechanism of claim 10 wherein when said handwheel is rotated in a second direction, opposite said first direction, said handwheel moves upon a threaded joint between said handwheel and said shaft, thereby reducing the engagement of said friction clutch and allowing rotation of said shaft in said second direction.

12. The boat winch hoist control mechanism of claim 10 where rotation of said shaft in said second direction, when said handwheel is held in a fixed rotational position, will cause said friction brake to engage by action of said roller clutch.

13. The boat winch hoist control mechanism of claim 8 further comprising a housing having at least one seal to protect said one-way clutch from an exterior environment.

14. The boat winch hoist control mechanism of claim 13 further comprising a sealed chamber within said housing containing said friction thrust member, said one-way clutch, and said friction clutch actuator.

15. The boat winch hoist control mechanism of claim 14 further comprising:

a cable reel having cable wrapped thereabout, said cable passing from said cable reel through said housing for connection to a boat lift; and gearing within said housing which couples said cable reel to said rotary shaft and which reduces a rotary velocity from said rotary shaft to said cable reel.

16. The boat winch hoist control mechanism of claim 8 wherein said friction clutch actuator is coupled between said motive power source and said rotary shaft.

17. A method of raising and lowering a water craft using a one-way clutch to prevent unintentional lowering of a water craft and a friction clutch to enable intentional lowering of said water craft, comprising the steps of:

applying a rotary force in a first direction to a hub, and thereby rotating said hub in a first direction;

engaging a friction clutch responsive to said hub rotation in said first direction;

winding a cable about a cable reel responsive to said rotating and engaging to thereby raise said water craft to a first elevation;

discontinuing said applying of said rotary force to said hub;

locking a one-way clutch responsive to said discontinuing, and thereby maintaining said raised water craft in said first elevation;

establishing a rotary force in a second direction opposed to said first rotary force direction to said hub, and thereby rotating said hub in said second direction;

disengaging said friction clutch responsive to said hub rotation in said second direction; and unwinding said cable from said cable reel responsive to said locking and disengaging.

18. The method of raising and lowering a water craft of claim 17, further comprising the step of increasing rotary force and decreasing an amount of rotation from said hub to said cable reel.

19. The method of raising and lowering a water craft of claim 17 further comprises the step of displacing said hub axially along said axis of rotation responsive to said step of rotating said hub in said second direction, said relative motion of said hub in turn initiating said disengaging step.

* * * * *